US007191773B2

(12) United States Patent
Vincent

(10) Patent No.: US 7,191,773 B2
(45) Date of Patent: Mar. 20, 2007

(54) PAINTBALL LOADING CONTAINER

(76) Inventor: Brad L. Vincent, 6 Williams Gate Pl., Oakland, KY (US) 42159

( * ) Notice: Subject to any disclaimer, the term of this patent is extended or adjusted under 35 U.S.C. 154(b) by 0 days.

(21) Appl. No.: 10/355,130

(22) Filed: Jan. 31, 2003

(65) Prior Publication Data

US 2004/0149275 A1 Aug. 5, 2004

(51) Int. Cl.
*F41A 9/61* (2006.01)

(52) U.S. Cl. ..... 124/49; 124/50; 124/45; 141/331

(58) Field of Classification Search ..... 124/49, 124/50, 45; 141/331, 332, 335, 336, 344, 141/345, 339, 340, 341
See application file for complete search history.

(56) References Cited

U.S. PATENT DOCUMENTS 3,263,664 A * 8/1966 Bauer et al. ..... 124/45
3,789,891 A * 2/1974 Bosch ..... 141/331
4,068,689 A * 1/1978 Krull ..... 141/93
4,723,531 A * 2/1988 Hampton ..... 124/45
5,282,454 A 2/1994 Bell et al.
5,809,983 A * 9/1998 Stoneking ..... 124/50
6,055,975 A 5/2000 Gallagher et al.
6,234,157 B1 5/2001 Parks
6,305,367 B1 10/2001 Kotsiopoulos et al.
6,425,424 B1 * 7/2002 Ellis Calvo et al. ..... 141/331
6,532,946 B1 * 3/2003 Paquette ..... 124/49
2002/0112713 A1 * 8/2002 Backeris et al. ..... 124/49
2003/0131835 A1 * 7/2003 Rice et al. ..... 124/49

* cited by examiner

*Primary Examiner*—John A. Ricci
*Assistant Examiner*—Urszula M Cegielnik

(57) ABSTRACT

The present invention is directed toward a magazine for loading paintballs into a guppy. The magazine is in the form of a tapered plastic container defining a chamber, an exit port leading from the chamber and a top loading opening leading to the chamber. A cover is snap mounted to the container and a paintball feed mechanism is mounted adjacent the bottom of the container next to the port. The feed mechanism comprising a slide housing mounted to the container and a slide member defining a beveled aperture sidably mounted in the slide housing, the slide member being spring biased in a closed position to provide selective access to paintballs held in the container chamber allowing a guppy to be mounted to a guppy support member which extends away from the feed mechanism to be loaded with paintballs.

17 Claims, 6 Drawing Sheets

PAINTBALL LOADING CONTAINER

RELATED APPLICATION

There are no related applications.

FIELD OF INVENTION

The present invention generally relates an apparatus for holding and dispensing ammunition, and in particular to a magazine or container adapted to be easily transported by a user for loading paintballs into guppies which are in turn are used by paintball players to fill their paintball guns or markers.

BACKGROUND OF THE INVENTION

The game of paintball is one in which two or more teams try to eliminate the other team or capture one another's flags or proceed through a simulated combat course. The players on the teams each carry a compressed gas-powered marker or gun that shoots paintballs—gelatin or plastic spherical capsules of approximately 68 caliber which contain a colored liquids. When a player is hit with a paintball from an adversary's gun, the paintball ruptures and leaves a colored "splat" on the hit player who is then "out" and must leave the game.

Quite unlike conventional explosive-propelled munitions, paintballs are relatively round and have an exterior formed from a semi-rigid gelatinous compound. The gelatinous compound is known to be affected somewhat by such variables as temperature and relative humidity, and is of course somewhat frangible. During a firing sequence, paintballs on occasion lodge against each other or other objects and block the passageway from the feeding chamber, resulting in a jam. While jamming is not new, knowledge from explosive munitions m is of little use with the very different paintballs.

As the game of paintball has grown in sophistication, semiautomatic paintball marker—guns that sequentially fire individual paintballs as fast as the trigger can be repeatedly pulled—have become more prevalent. It is advantageous and increases the chances of success to be able to fire rapidly and continuously in order to increase the chances of hitting an opponent with a paintball. The high firing rate capability of semiautomnatic paintball markers has necessitated the use of paintball bulk loader devices which can be used to fill guppies or pods carried by the players. The paintball canisters called pods or guppies generally holds from 100 to 150 paintballs and are most commonly used by paintball enthusiasts. Guppies are the supplemental magazine of choice used to fill the marker hoppers. The pods or guppies, which are used to fill the magazine hoppers of the markers, typically carry a number of paintballs, depending on the capacity of the marker feed hopper.

While the compressed gas cylinders used to propel the paintballs can provide up to 1000 or more individual charges or shots, the magazines or hoppers attached to the paintball guns typically are limited to holding only about one or two hundred paintballs. While large supplemental hoppers have been used which are attached to the marker hopper to increase firepower, these supplemental hoppers or paintball containers are quite unwieldly and limit the players maneuverability and gun movement.

Several guppies are typically carried on a belt of a player and are individually removed, opened and emptied into a paintball gun hopper before the hopper runs out of paintballs. These guppies can be quickly used up when the game action becomes fast and furious and the time needed to refill the guppies when they are emptied can affect the outcome of a game. It is obviously an undesirable situation when a player has sufficient compressed gas to continue shooting, but runs out of paintball ammunition.

A player without paintball ammunition is particularly vulnerable insofar as the distinctive sound of a paintball marker being fired with an empty hopper is easily recognized by other players. As a result, an opponent can rush upon and shoot the player with the empty gun without risk of being shot by that player.

A number of patents have been directed toward magazines for use with paintball guns to increase their usable paintball supply but little attention has been directed toward the need to quickly fill the guppies during the course of a game and prior to the beginning of the start of the game.

Basic paintball magazines are little more than large hoppers with a feed tube extending therefrom, a sort of closed funnel through which paintballs are dropped into the firing chamber. The passageway ultimately tapers to isolate single paintballs for deposit into the firing chamber. Usually this is not a gradual taper, but a sudden transition, to reduce the likelihood of two balls getting stuck against each other. However, when one paintball does lodge against the other, the user must shake the gun to free the balls.

U.S. Pat. No. 5,282,454 issued Feb. 1, 1994 discloses a marker magazine with sloping ends and side walls that lead downward to a tubular passageway referred to as a feed tube. Gravitational forces tend to urge the paintballs to the feed tube, as is known in the prior art. The feed tube is connected to the firing chamber of the gun, so that as the paintballs are carried through the tube, they are fed into the firing chamber. Occasionally, a pair of paintballs will simultaneously drop into the opening of the feed tube so that neither can pass, leading to a jam.

U.S. Pat. No. 6,305,367 issued Oct. 23, 2001 is directed toward a battery driven agitator in a hopper feeder for a paintball gun. The hopper feeder is a housing with a rear opening covered by a hinged lid through which paintballs are loaded and an outlet opening leading into a feed tube portion. The feed tube is preferably removably received in the paintball inlet of the paintball gun.

U.S. Pat. No. 6,055,975, issued May 2, 2000 is also directed toward a reservoir which holds paintballs and feeds paintballs into the open hopper of the paintball marker (pistol, rifle). A guppy is shown in FIG. 12 and different reservoirs are shown in FIGS. 11 and 14. The spout of the reservoir is a one piece plastic container with a connector member having a bayonet connection.

U.S. Pat. No. 6,234,157 issued May 22, 2001 is directed to a paintball gun loader speed collar. The collar attaches onto a guppy which is then mounted to a loader magazine from Brass Eagle.

SUMMARY OF THE INVENTION

The present invention is directed toward a reloadable magazine for loading paintballs into a guppy. The magazine is in the form of a tapered plastic container defining a chamber, an exit port leading from the chamber and a top loading opening leading to the chamber. A cover is snap mounted to the container over the top loading opening and a paintball dispensing assembly is mounted to bottom of the container adjacent the exit port. The dispensing assembly is a slide housing integrally molded with the container and a slide member slidably mounted in the slide housing. The slide member is spring biased in a closed position covering the exit port to preclude passage of paintballs and can be opened to provide selective access to paintballs held in the container chamber allowing a guppy mounted adjacent the exit port to be quickly loaded.

The present invention has been developed to fulfill the needs noted above and therefore has as an object a device storing and dispensing up to 1000 or more paintballs using a single paintball reservoir.

Still another object of the invention is the provision of a reusable and reloadable paintball storing and dispensing device which is easily and unobtrusively carried by a paintball player and which may be operated to quickly reload one or more paintball guppies.

It is still another object of the invention to provide a preloaded paintball container with a handle and cover.

It is yet another object of the invention to provide a guppy loading device which is made of plastic and has a tough durable construction.

It is still another object of the invention to provide a paintball feeding container which requires no assembly, is easy to operate and cleans after use.

These and other objects, advantages, and novel features of the present invention will become apparent when considered with the teachings contained in the detailed disclosure which along with the accompanying drawings constitute a part of this specification and illustrate embodiments of the invention which together with the description serve to explain the principles of the invention.

DETAILED DESCRIPTION OF THE INVENTION

Figure 1:
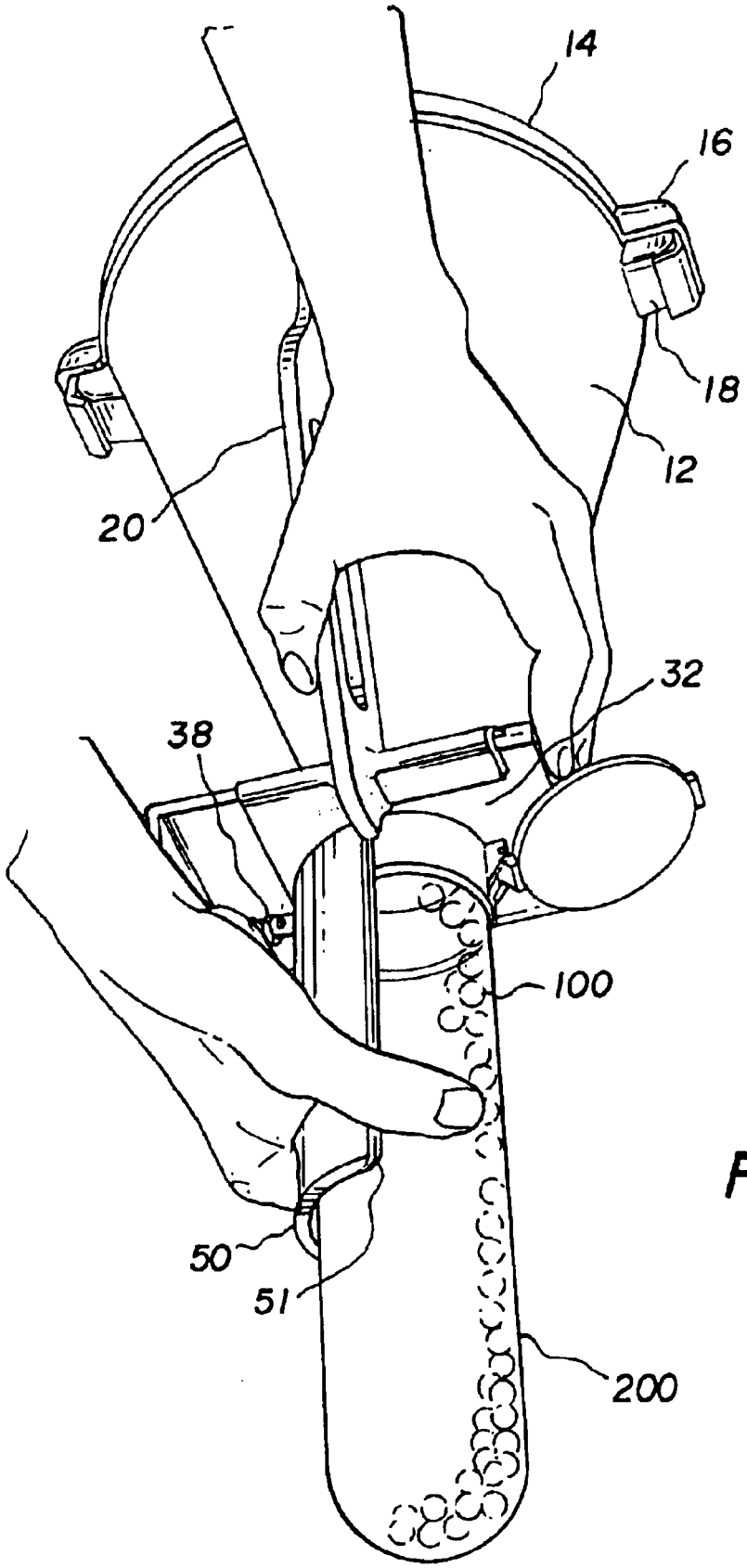
FIG. 1 is a perspective view of the present invention shown during loading of paintballs in a guppy.
Figure 2:
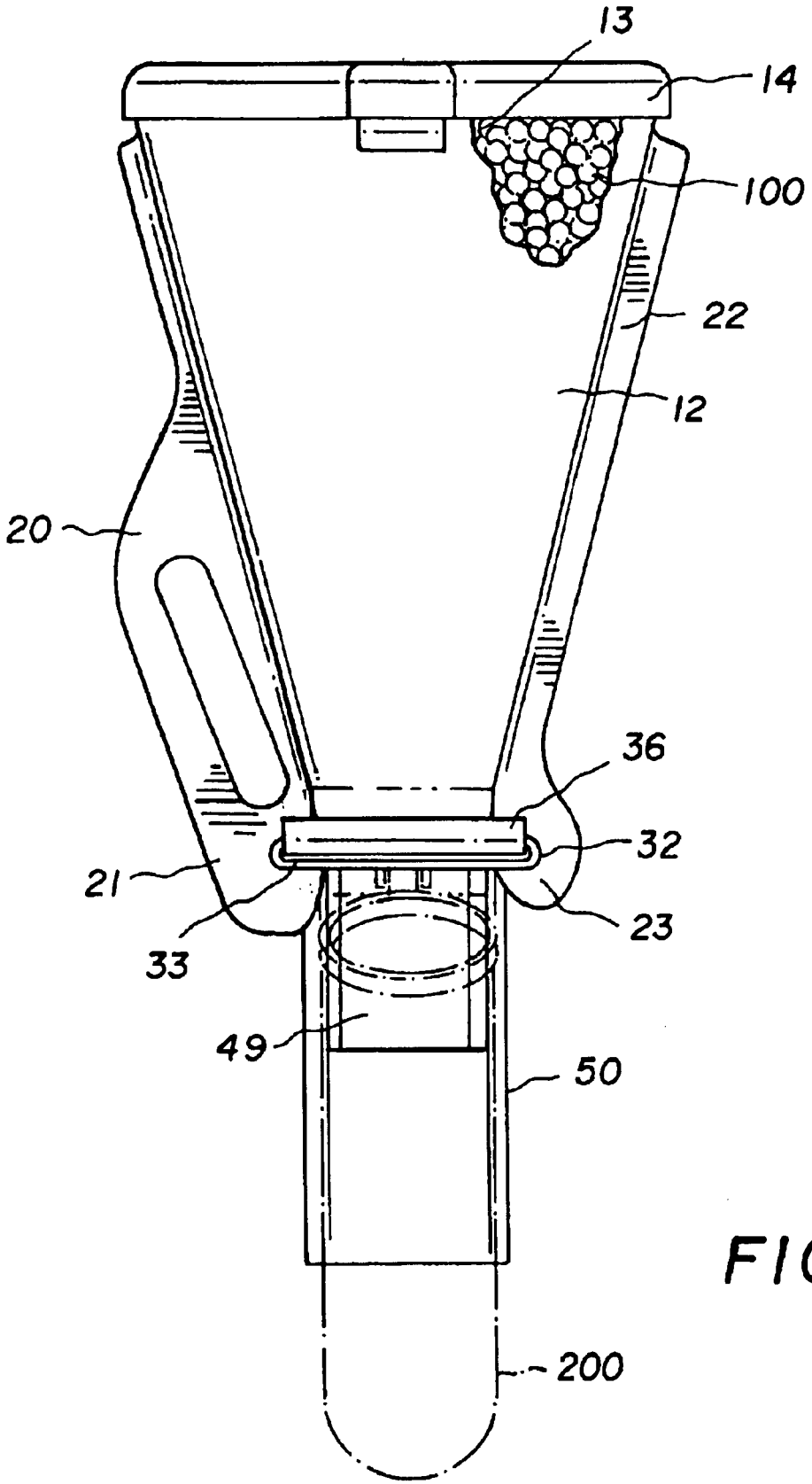
FIG. 2 is right side elevational view of the invention shown in FIG. 1 with a section partially removed to show the paintballs with the guppy being shown in phantom.
Figure 3:
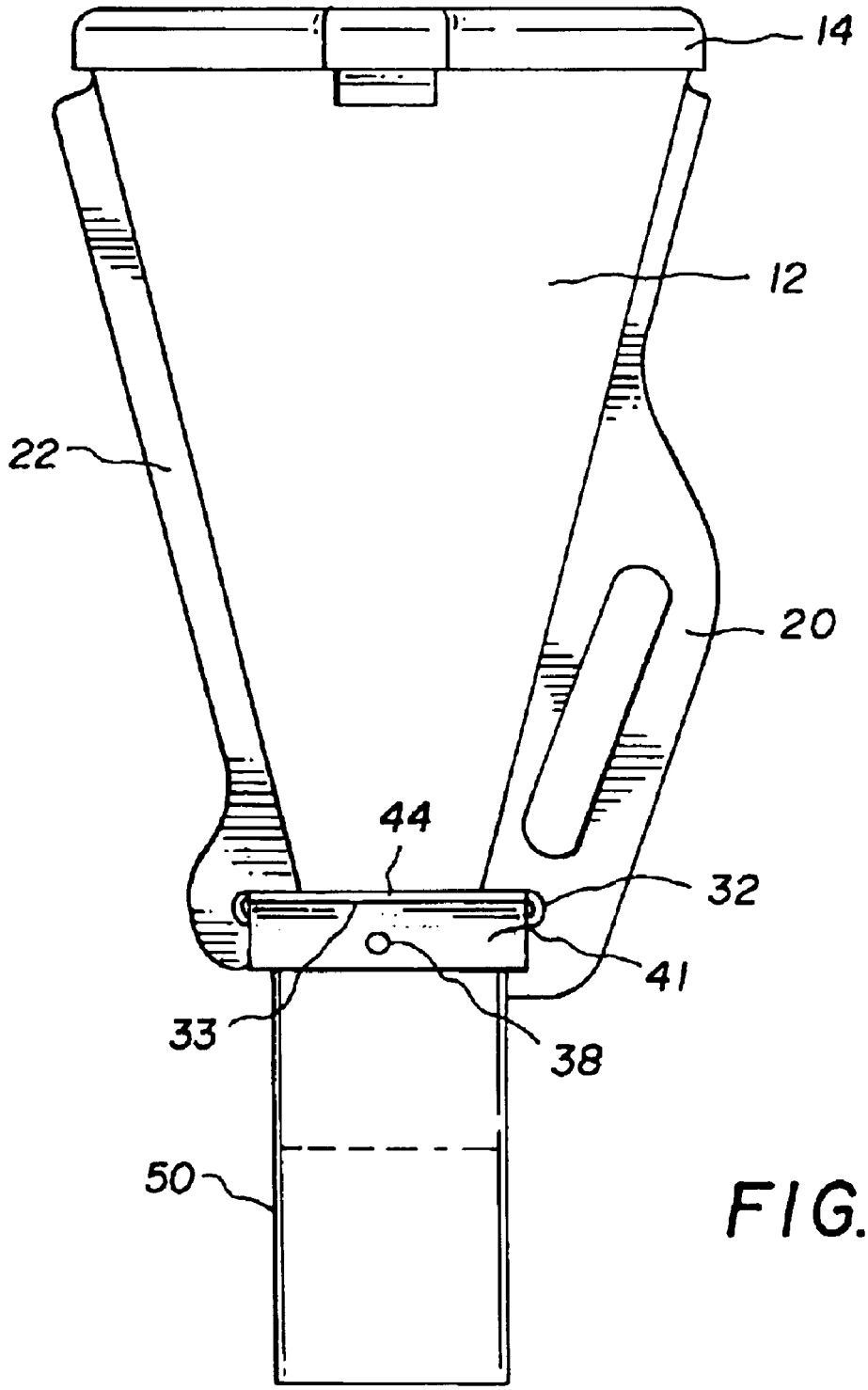
FIG. 3 is a left side elevational view of the invention shown in FIG. 1 with the guppy removed.
Figure 4:
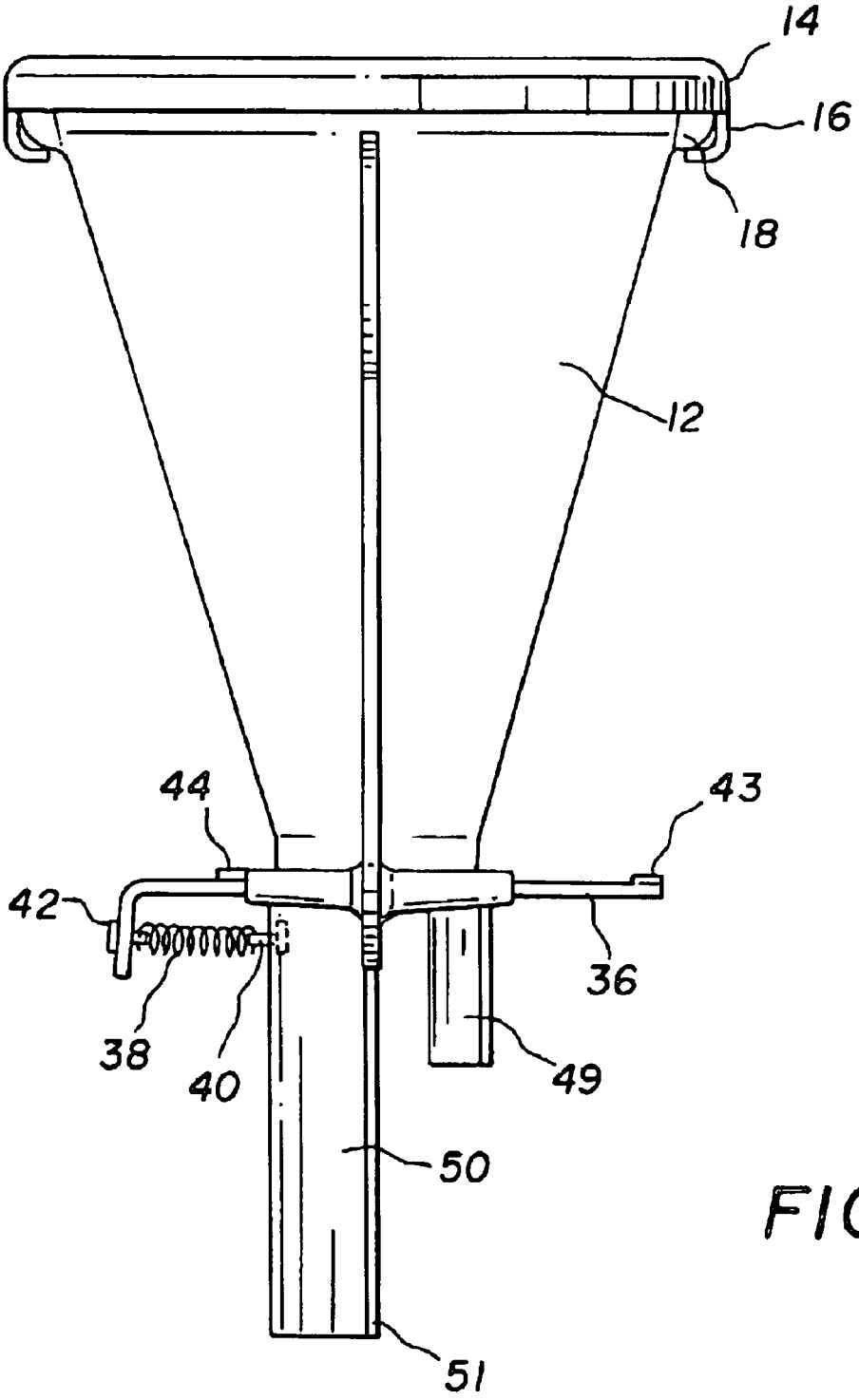
FIG. 4 is a front elevational view of the invention shown in FIG. 1 with the guppy removed.
Figure 5:
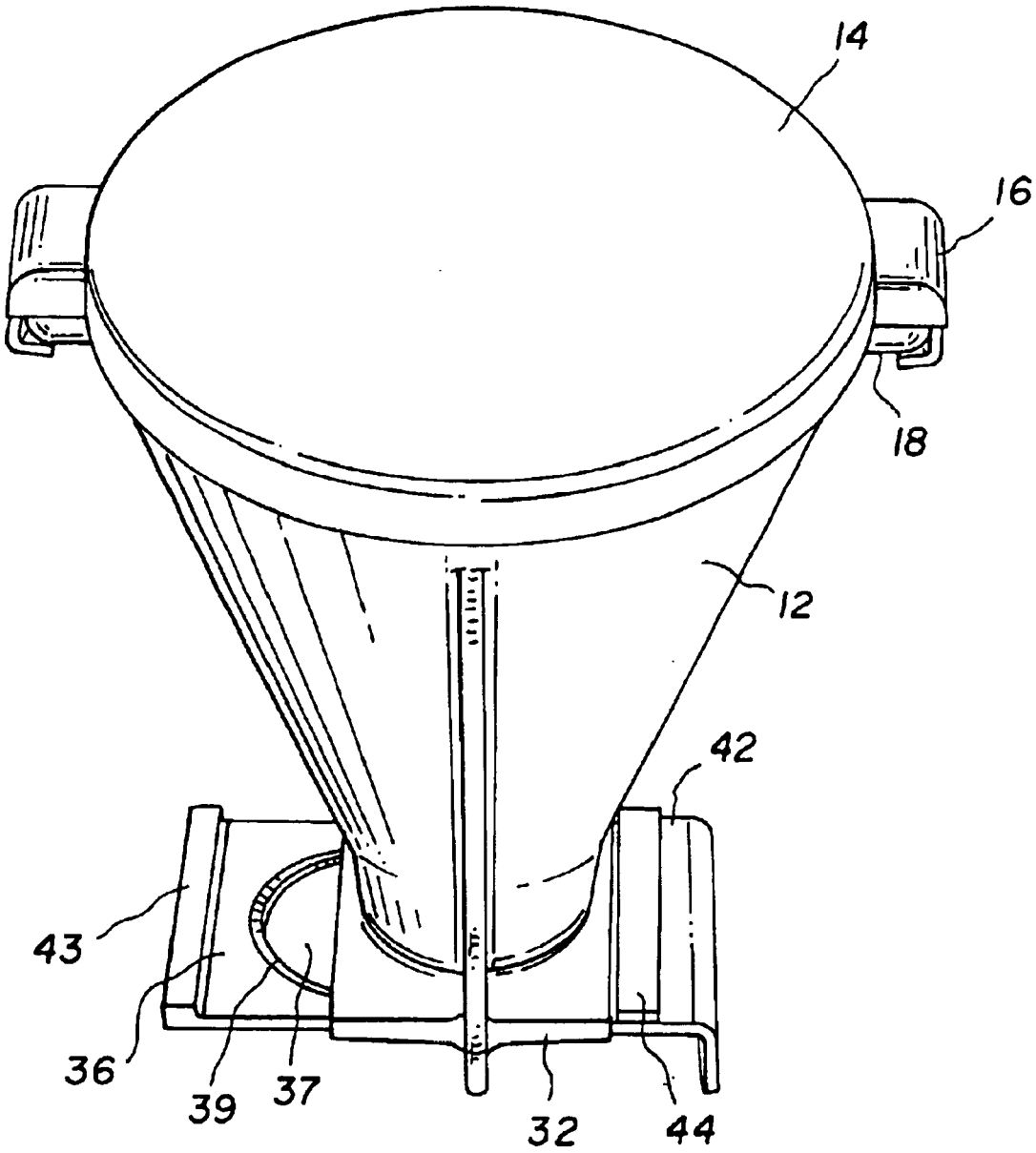
FIG. 5 is an enlarged perspective view of the container and paintball feed mechanism shown in FIG. 1 with the guppy support removed.
Figure 7:
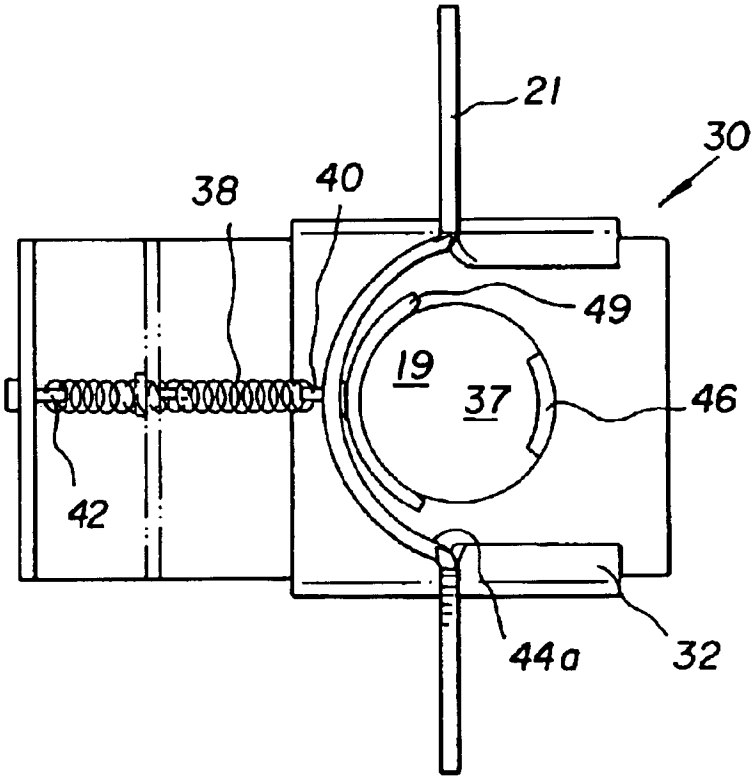
FIG. 7 is a bottom view of the view of the paintball mechanism feed of FIG. 6 with the slide in the open position showing the biasing spring in both the closed and open positions.

The preferred embodiment and best mode of the present invention is shown in FIGS. 1–7.

In carrying out principles of the present invention an essentially jam free paintball container feeder apparatus is provided for use in filling guppies.

The container feeder apparatus includes a housing for internally storing a quantity of paintballs which are gravity fed via a bottom outlet opening through which the stored paintballs may sequentially drop into a specially designed feed mechanism incorporated in the container feeder apparatus.

The present invention comprises a container housing 12 which is adapted to hold up to 1000 or more paintballs 100. The paintballs are normally of 68 caliber with a spherical configuration. The container is placed in a position over a pod or guppy 200 to achieve gravity feeding of the paintballs into the guppy 200. A cap or cover 14 is provided on the top of the housing 12 for loading paintballs 100 into the chamber 13 of the housing 12. The cover 14 has flexible lock members 16 formed on opposite sides of the cover body which are adapted to snap over locking knobs 18 integrally formed on the container body so that the cover 14 is firmly held in place. However any form of locking mechanism could be substituted for the present cover attachment means including, as for example, strapping such rubber straps which fit over pins extending from the container body, hinges, a bayonet fitting, threading, metal snap mechanisms and the like.

The container 12 is preferably constructed of a rigid molded plastic material and has a conical or funnel shape with a tapering cross section for channeling and funneling paintballs into the exit port 19 located at the base of the container. The exit port 19 is circular leading into a sleeve 32 of the feed mechanism and has the same or similar diameter size as the aperture 37 of the slide member 36 which is mounted adjacent the exit port in the sleeve 32. The feed mechanism 30 is secured to the bottom of the container 12 and is integrally formed with or braced by handle 20 which extends downward from a position below the bottom of the container housing to a point near to the top of the container housing and a support rib 22 positioned on the opposite side of the container housing 12 which also extends from below the bottom of the container housing to a position near the top of the container housing. The bottom section 21 of the handle 20 and the bottom section 23 of support rib 22 are integrally formed with a slide rail or sleeve 32 which holds the spring biased closure slide member 36 within chamber or channel 33 of sleeve 32. The sleeve 32 defines axially aligned circular aperture 34 and the curved aperture 34 is preferably the same area size as exit port 19 with approximately ½ of the curved aperture 34 being surrounded by guppy stop member 50.

Figure 6:
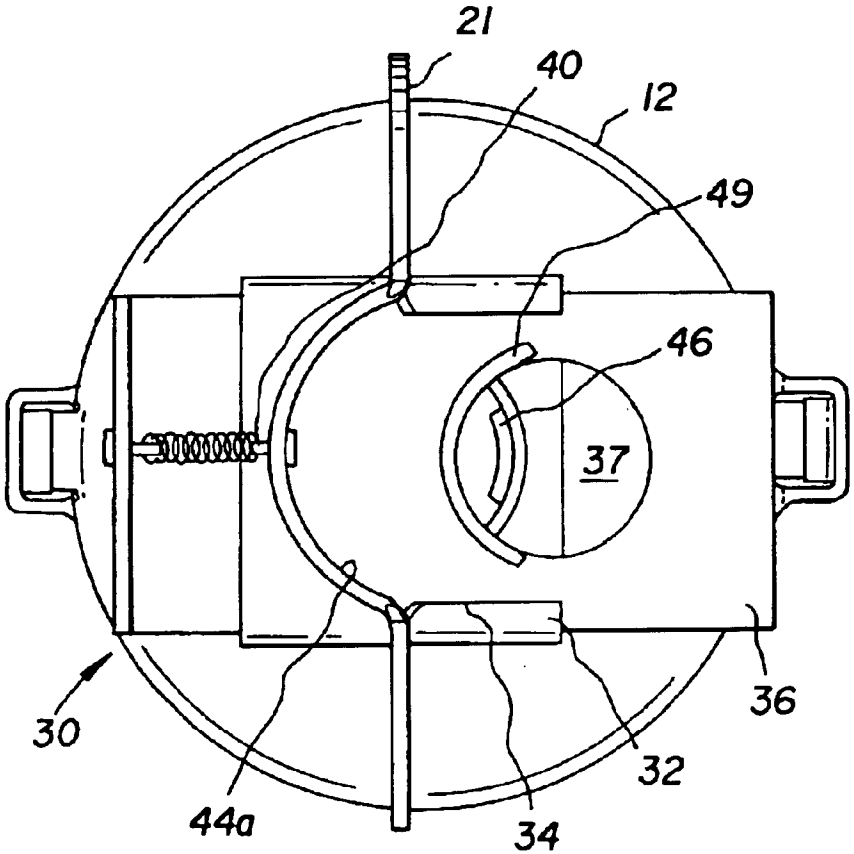
FIG. 6 is an enlarged perspective view of the container and paintball feed mechanism of FIG. 1 with the slide in the closed position.

A slide member 36 is spring mounted to the top section 44*a* of the guppy support member 50 with a coil spring 38. The coil spring has one end secured to a pin 40 mounted in a hole cut in section 50 and the other end is secured to a pin 42 mounted to slide 36 as is most clearly shown in FIGS. 4, 6 and 7. The coil spring 38 continually biases the slide member 36 in a closed position as shown in FIG. 6. The slide member 36 has a circular opening 37 cut there through which has a beveled circumference 39 (see FIG. 5) with a diameter which will accommodate several paintballs simultaneously. The circular opening 37 is preferably 2¼ inches in diameter which will accommodate three side by side paintballs with clearance to prevent jamming. The beveled edge 39 of the opening 37 keeps the paintballs from jamming the port when the slide member 36 is closed. The slide member 36 has a guppy support seat or member 49 secured to slide member 36 in the form of a half tube which causes the slide to open when the guppy 200 is pushed into the guppy stop member 50. The slide sleeve 32 has guppy stop member 50 secured to one side opposite the container housing port 19 in the form of a half tube which allows the guppy 200 to stop when the support seat member 49 comes in contact with stop member 50. The guppy stop member is about 6 inches long and the end edges 51 of the arcuate member 50 are flared outward to allow the guppy 200 to be easily seated. The slide member 36 has a transverse flange 41 on one end, a push bar 43 on the other end and a stop bar 44 which acts as a stop to limit the distance that the slide member 36 can be moved in a closed direction. An arcuate support member 46 is located in the aperture 34 and is secured to the sleeve 32.

The principles, preferred embodiments and modes of operation of the present invention have been described in the foregoing specification. However, the invention should not be construed as limited to the particular embodiments which have been described above. Instead, the embodiments described here should be regarded as illustrative rather than restrictive. Variations and changes may be made by others without departing from the scope of the present invention as defined by the following claims.

What is claimed is:

1. A container for dispensing paintballs, comprising:

a container housing; said container housing defining a tapered chamber, an exit port from said chamber and an opening providing access to said chamber, a cover removably mounted to said container housing, a paintball dispensing assembly mounted to said container adjacent said exit port, said dispensing assembly comprising a slide housing and a slide member slidably mounted in said slide housing through the action of an opening means which biases said slide member in a closed condition, said slide member defining an opening which provides selective access to said container chamber and a guppy support mounted to said container.

2. The container of claim 1, wherein said guppy support comprises a rigid arcuate member with flared edges extending away from said container with one end adjacent said exit port.

3. The container of claim 1 wherein said container is funnel shaped.

4. The container of claim 1 wherein said container is cone shaped.

5. The container of claim 1 wherein said slide housing is a sleeve.

6. The container of claim 1 wherein said slide member defines a beveled edge around said circular opening.

7. The container of claim 1 wherein said container housing defines a plurality of integrally formed locking members.

8. The container of claim 7 wherein said cover has locking snap means secured thereto which snap over the locking members of said container housing.

9. The container of claim 1 wherein said slide member is spring mounted to said container and biased in a closed condition.

10. A magazine for loading paintballs into a guppy, comprising:

a container housing; said container housing defining a tapered chamber, an exit port leading from said chamber, said exit port being a size to accommodate a plurality of paintballs and an opening providing access to said chamber, a cover removably mounted to said container, a paintball guppy feed mechanism mounted to said container housing adjacent said port, said feed mechanism comprising a slide sleeve and a slide member slidably mounted in said slide sleeve, said slide sleeve defining aperture means which provides selective access to said container chamber of a size allowing a plurality of paintballs to pass therethrough, said slide member defining an aperture which can be aligned with said sleeve aperture means and being spring biased in a closed position and a guppy support mounted to said container.

11. The container of claim 10 wherein said container housing has a handle extending longitudinally along an outer surface to provide support, said container having also includes a longitudinal support rib on the outer surface of said container housing located opposite from said handle.

12. The container of claim 10 wherein said slide member defines a circular opening therein which can be aligned with said sleeve aperture means and includes stop means limiting its slideable movement within said slide housing, said slide member defines a beveled edge around said circular opening.

13. A magazine for loading paintballs into a guppy, comprising:

a container housing; said container housing defining a tapered chamber, an exit port at the smaller tapered section of said chamber and an opening providing access to said chamber, a cover removably mounted to said container with locking means, a rib means running longitudinally along an outer surface of said container housing surface, a paintball feed mechanism mounted to said container housing adjacent said exit port, said feed mechanism comprising a slide housing mounted to said container housing and a slide member slidably mounted in said slide housing, said slide housing defining aperture means therein aligned with said exit port to allow paintballs to pass therethrough, said slide member defining stop means which limits movement in said slide housing and a circular aperture which provides selective access to said container chamber and an arcuate guppy support member mounted to said slide housing.

14. The container of claim 13 wherein said slide member defines a beveled edge around said circular aperture.

15. A container for dispensing paintballs, comprising:

a container housing; said container housing defining a tapered chamber, an exit port from said chamber and an opening providing access to said chamber, said exit port being a circular aperture having a diameter greater than the diameter of three paintballs of 68 caliber, a cover removably mounted to said container housing, a paintball dispensing assembly mounted to said container adjacent said exit port, said dispensing assembly comprising a slide housing and a slide member slidably mounted in said slide housing, said slide member defining an opening which provides selective access to said container chamber and a guppy support mounted to said container.

16. A container for dispensing paintballs, comprising:

a container housing; said container housing defining a tapered chamber, an exit port from said chamber and an opening providing access to said chamber, a cover removably mounted to said container housing, a paintball dispensing assembly mounted to said container adjacent said exit port, said dispensing assembly comprising a slide housing and a slide member slidably mounted in said slide housing, said slide member defining an opening which provides selective access to said container chamber and a guppy support mounted to said container, said slide housing defining axially aligned apertures and said slide member defining a circular opening therein which can be aligned with said port opening and said sleeve apertures and stop means mounted to said sleeve member limiting its slideable movement within said slide housing.

17. A container for dispensing paintballs, comprising:

a container housing; said container housing defining a tapered chamber, an exit port from said chamber and an opening providing access to said chamber, a handle extending longitudinally along an outer surface of said container housing to provide support and a longitudinal support rib positioned on the outer surface of said container housing located opposite from said handle, a cover removably mounted to said container housing, a paintball dispensing assembly mounted to said container adjacent said exit port, said dispensing assembly comprising a slide housing and a slide member sidably mounted in said slide housing, said slide member defining an opening which provides selective access to said container chamber and a guppy support mounted to said container.

* * * * *